United States Patent [19]

Pistritto et al.

[11] Patent Number: 4,785,655

[45] Date of Patent: Nov. 22, 1988

[54] METHOD AND ARRANGEMENT FOR PRODUCING KNOCKOUTS FOR ELECTRICAL EQUIPMENT CABINETS

[75] Inventors: Tino J. Pistritto, Waterford; John H. McIver, Farmington, both of Conn.

[73] Assignee: General Electric Company, New York, N.Y.

[21] Appl. No.: 300

[22] Filed: Jan. 5, 1987

[51] Int. Cl.[4] ..... B21D 28/10

[52] U.S. Cl. ..... 72/326; 29/413; 29/418; 83/25

[58] Field of Search ..... 72/326, 325, 332; 29/413, 414, 416, 418; 83/108, 25

[56] References Cited

U.S. PATENT DOCUMENTS

| | | | |
|---|---|---|---|
| 412,618 | 10/1889 | Holz | 83/25 |
| 987,144 | 3/1911 | Kuechenmiester | 83/108 |
| 2,122,368 | 6/1938 | Engler | 83/25 |
| 2,350,004 | 5/1944 | Whistler et al. | 72/326 |
| 2,561,050 | 7/1951 | Charron et al. | 83/25 |
| 3,383,065 | 5/1968 | Bergeron et al. | 83/108 |
| 3,580,122 | 5/1971 | Powell | 83/108 |
| 3,993,010 | 11/1976 | Taniuchi | 72/326 |
| 4,611,480 | 9/1986 | Willetts | 72/326 |

*Primary Examiner*—Daniel C. Crane

*Attorney, Agent, or Firm*—Walter C. Bernkopf; Richard A. Menelly; Fred Jacob

[57] ABSTRACT

A method of producing concentric knockouts on a planar portion of sheet metal to be formed into an equipment housing. The sheet metal is successively positioned with respect to punch sets of increasing diameter and knockout portions of increasing size are sequentially cut, but for retaining anchors, to surround previously cut portions. Successive knockout portions are cut by punches moving in opposing directions. The punch sets comprise a cutting punch and an embedding punch. The cutting punch cuts and displaces the knockout in a first direction and the embedding punch of the same punch set moves in an opposite direction to at least partially restore the cut and displaced portion within the surrounding portions of the sheet metal.

10 Claims, 7 Drawing Sheets

170
200
188
172
138
182
185
192
174
186
190
183
168
184
198
144
194
176
50
196
178
68
142
162
146
154
160
140
152
148
161
156
166
150
158
164

7a.

7b.

METHOD AND ARRANGEMENT FOR PRODUCING KNOCKOUTS FOR ELECTRICAL EQUIPMENT CABINETS

This invention pertains to improved methods and arrangements for making multiple knockouts for cabinets and primarily for electrical equipment cabinets.

Upon on-site installation of electrical equipment cabinets, electrical conductors are connected from external power sources and loads to the electrical components within the cabinets. These conductors are typically encased in conduits, e.g., pipes or tubes. The conduits generally enter the cabinet via holes in the side, top and/or bottom walls of the cabinet. The number of conduits to be installed and their position with respect to the cabinet walls varies from one installation to another. It is impractical to drill these holes during installation. The cabinets also can not be manufactured and shipped with holes existing at all of the various locations where conduits may be installed. It is undesirable and generally not permitted to have unoccupied, i.e., empty, holes subsequent to installation. In the case of outdoor installations, holes, except for drain holes, could permit entry of moisture and water. Also, holes or openings in the cabinet are undesirable because of the electrical potential, currents and conceivable arcs present within the cabinet. Metallic members, e.g., wires, might be unintentionally introduced into such openings so as to contact interior components having electrical potentials. Electrical equipment cabinets are therefore provided with a plurality of "knockouts". These knockouts comprise punchings that are usually of circular configuration. The punchings, retained to the cabinet walls by one or more small anchors, can be selectively removed by the installing electrician.

The diameter of installed conduits varies and depends on the electrical parameters of the internal conductors. Typically, there are at least a dozen conduit sizes ranging from a fraction of an inch to at least four inches. Therefore, cabinets contain knockouts constructed so that one knockout can be converted into a hole of any one of a plurality of predetermined diameters. Such a knockout comprises multiple punchings, including an inner punching and one or more externally surrounding punchings, and is hereinafter referred to as a "multiple knockout". Usually such multiple knockouts comprise concentric punchings including an inner circular portion and concentrically surrounding annular portions, i.e., rings, which thus form several concentric circular portions. An installer can pry out one or more of the portions to form an opening of desired diameter. Multiple knockouts should be manufactured so that one or more of the portions can be easily removed by the installer and so that removal does not result in the unintentional removal of additional knockout portions. The portions of the knockout should also remain in place, except when intentionally removed by the installer, despite the shocks and vibrations encountered when the cabinet is shipped. These requirements are achieved by punching the multiple knockouts so that each portion is completely severed about its periphery except for one or more anchors that retain each portion to its surrounding portion.

Multiple knockouts are usually produced on planar sheet metal stock prior to the stock being bent or shaped into cabinet walls. These knockouts have been made in punch presses equipped with cluster dies. The cluster dies comprise a cutting punch and an embedding punch positioned, respectively, on opposing sides of the metallic sheet. The cluster dies commonly comprise plural concentric ring-shaped surface configurations having detents to provide anchors. Thus, a single punching produces a multiple knockout with concentrically cut circular portions of predetermined diameter retained by anchors. Cluster dies, and particularly those having many concentric portions, thus have a complex configuration. They must be accurately machined within very small tolerances to assure that the knockouts conform to the above specified requirements. These complex cluster dies are expensive and increasingly difficult to procure. This is a problem since die sets must be replaced occasionally. Also, additional die sets must be procured if the number of knockout openings, e.g., the number of circular portions, or the sizes, e.g., diameters, of the openings are changed.

When a knockout is punched by a cluster die set, its inner circular portion and concentrically surrounding rings are distended from one another orthogonally to the plane of the sheet metal. The resulting gaps or occlusions are undesirable for the reasons specified above. Therefore, the sheet metal member containing the knockouts is usually pressed, in a separate operation, to close the gaps by at least partially reinserting the distended metallic portions within one another. However, the pressing operation may produce stresses in the panel member and thus result in an undesirable deformation of the panel.

OBJECTS OF THE INVENTION

It is an object of the present invention to provide an improved method and arrangement for making multiple knockouts for use in equipment cabinets.

It is a further object for readily making multiple knockouts having any of a desired combination of opening sizes without requiring special and complex dies or tools for each separate combination of sizes.

It is yet a further object to make such knockouts utilizing dies of simple configurations.

It is another object to make multiple knockouts devoid of undesirable gaps or spaces without requiring a separate pressing operation.

SUMMARY OF THE INVENTION

In accordance with one aspect of the invention, multiple knockouts are formed on a planar portion of sheet metal in a hydraulic punch comprising a plurality of displaced punch sets of different diameter. The sheet metal is successively positioned with respect to punch sets of increasing diameter and knockout portions of increasing size, e.g., diameter, are sequentially cut so as to surround the previously cut portions. The portions are cut so as to be retained to externally surrounding portions by one or more anchors and are preferably cut to be circular and concentric with respect to each other. The portions are cut by displacing the cutting punches orthogonally with respect to the plane of the sheet metal. Knockout portions of successively increasing size are sequentially cut by different cutting punches that move in opposing directions. Thus, the cutting punch forming the inner, i.e., smallest, portion moves in a first direction and the cutting punch forming the next largest portion moves in an opposing second direction. The punch sets comprise a cutting punch and an embedding punch. In accordance with another aspect of the invention, the cutting punch is moved in a specified direction to cut and displace a knockout portion and the embedding punch of the same punch set is subsequently moved in an opposite direction to at least partially restore the cut and displaced portion within the surrounding portions of the sheet metal.

BRIEF DESCRIPTION OF THE DRAWINGS

FIG. 1*a* illustrates removal of the inner circular portion and FIGS. 1*b* and 1*c* illustrate removal of the ring portion surrounding the circular portion.

DETAILED DESCRIPTION OF THE INVENTION

Figure 1A:
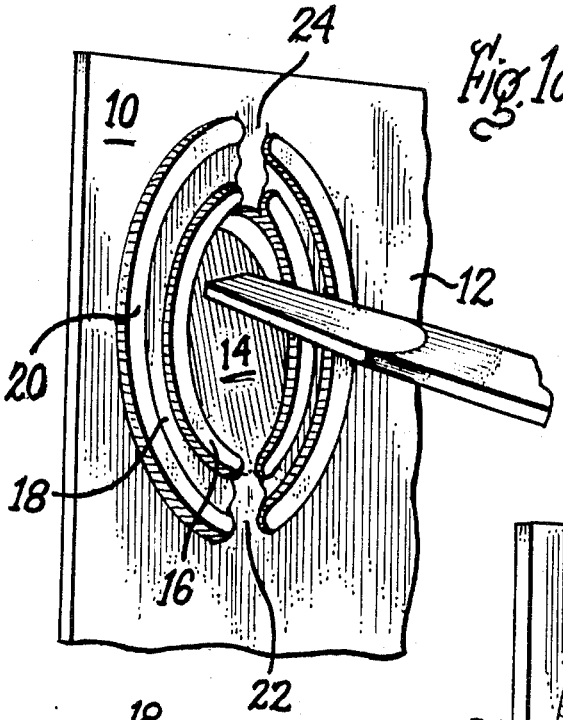
Fig. 1a. (PRIOR ART)
FIGS. 1*a*, 1*b*, and 1*c* are pictorial illustrations of prior art concentric knockouts and of their removal.
Figure 1C:
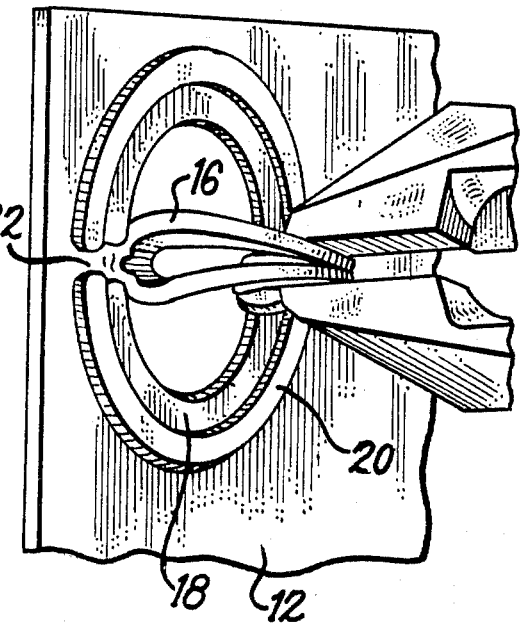
Fig. 1c. (PRIOR ART)
Figure 1B:
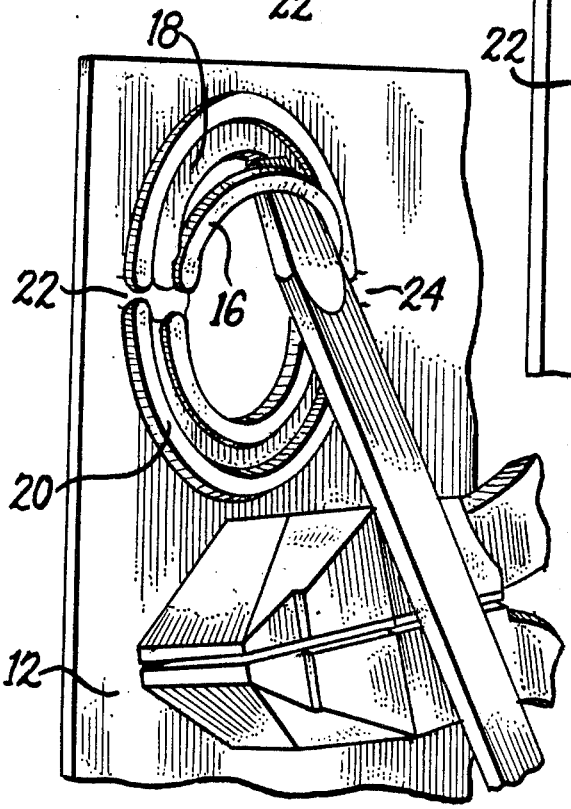
Fig. 1b. (PRIOR ART)

FIGS. 1*a*, 1*b* and 1*c* illustrate a multiple knockout and removal by the installer of a portion thereof to provide an opening of desired diameter. The general configuration and method of removal are of the prior art and are described to provide a background of the invention. Knockout 10 is formed in a planar portion 12 of the wall of an equipment cabinet. This knockout comprises inner circular portion 14 and first, second and third concentrically surrounding ring portions 16, 18 and 20, respectively. The installer can thus make an opening of any one of four predetermined diameters. Multiple knockouts can, of course, be of different configuration and may have more or less removable portions. Rings 16, 18 and 20 are each retained by two sets of anchors 22 and 24. The inner portion 14 is retained by a single anchor 22. The number and position of anchors can be varied. Concentric ring portions 16 and 20 extend outward, i.e., away from the exterior surface of the cabinet wall portion, such that portions 14, 16, 18 and 20 have sequentially alternating surface contours.

FIG. 1*a* illustrates removal of the central, inner, circular portion 14 by striking the central portion with a screwdriver or chisel at a point furthest from anchor 22. If necessary, portion 14 is bent with pliers until the anchor breaks. FIGS. 1*b* and 1*c* illustrate removal of first concentric ring portion 16. FIG. 1*b* illustrates a first half portion of 16 being bent outward with a screwdriver located midway between anchors 22 and 24. After both halves are bent, they are removed. FIG. 1*c* illustrates removal of outwardly bent portion 16 by means of pliers.

Figure 2:
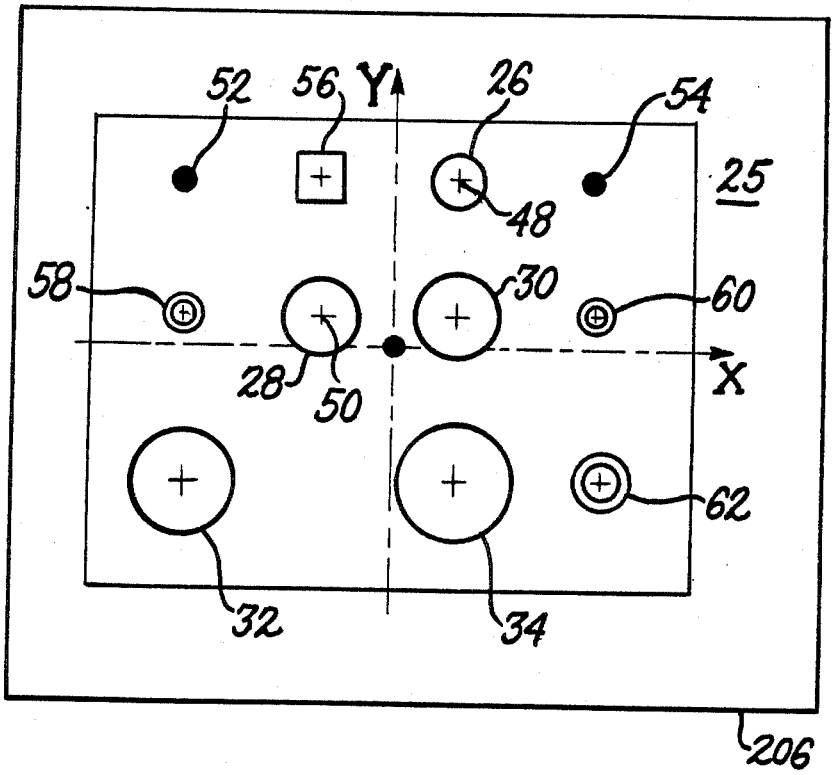
FIG. 2 is a simplified representation of the top view of a representative die set containing a plurality of punch sets.

In accordance to the invention, the concentric knockout is preferably produced in a hydraulic press. The embodiments disclosed herein utilized a Salvagnini S4 hydraulic punching-shearing machine sold by Salvagnini Transferica S.P.A., Sarego, Italy. A plurality of punch sets of differing diameter and of a construction subsequently described are installed in die sets located in magazines of the machine. FIG. 2 is a top view of the punch sets (26–34, 52–62) contained in a die set 25 and of the work piece, i.e., sheet stock 206. Each of the punch sets has its center, identified as "+", located, respectively, at different predetermined x and y coordinate locations with respect to the center of the die set, as identified in the following Table 1. Punch sets 26, 28, 30, 32 and 34 are utilized in accordance with the one aspect of the invention for forming multiple knockouts having a desired combination of circular portions. Each of these punch sets has a different cutting diameter as set forth in Table I.

TABLE I

| PUNCH SET | CUTTING DIAMETER (mm) | DIRECTION OF CUT | DIRECTION OF EMBEDDING | CENTER LOCATION x coord (mm) | CENTER LOCATION y coord (mm) |
|---|---|---|---|---|---|
| 26 | 50.8 | DOWN | UP | 52.5 | 144 |
| 28 | 63.5 | UP | DOWN | −62.5 | 28 |
| 30 | 76.2 | DOWN | UP | 52.5 | 28 |
| 32 | 92.0 | UP | DOWN | −178.8 | −115 |
| 34 | 104.6 | DOWN | UP | 52.5 | −115 |

A multiple knockout can be made by cutting the sheet stock sequentially with punch sets 26, 28, 30, 32 and 34 in the order recited. This produces a multiple knockout having a central circular portion produced by punch set 26 and four concentric circular portions produced by the other punch sets. For this purpose, the sheet stock 206 (of FIG. 2) is first oriented so that the center of the intended knockout is coaxially oriented with the center axis 48 of punch set 26. The cutting punch of punch set 26 is then moved in a downward direction. Generally, the first punching, producing the portion of smallest diameter, is made in a direction extending from the outside toward the inside surface of the eventual wall of the equipment cabinet. Subsequent to a restoring operation described below, the sheet stock is repositioned along the x and y coordinates with respect to the die set so that the center of the intended knockout is coaxially oriented with the center axis 50 of the second punch set 28. The cutting punch of punch set 28 then moves in an upward direction, i.e., opposite to the direction of the above described motion of the cutting punch of punch set 26, to cut a circular portion having a diameter larger than that produced by punch set 26, followed by another restoring operation. Concentric punchings of increasing diameter are thus sequentially produced by punch sets 26, 28, 30, 32 and 34. As shown in Table I, the cutting punches of successive punch sets move in opposing directions. The above identified punch sets can also be used to make multiple knockouts of different configuration. For example, knockouts with only two concentric portions could be made with punch sets 26 and 28 or 30 and 32; knockouts of three concentric portions with punch sets 26, 28 and 30 or punch sets 30, 32 and 34; knockouts having four concentric portions could be made with punch sets 26, 28, 30, 32. Additional knockout configurations might be produced by cutting the initial, i.e., central, portion in the "up" direction. With punch sets 26–34 this could include knockouts with two concentric portions made by punch sets 28 and 30, or 32 and 34; with three concentric portions made by punch sets 28, 30 and 32; and with four concentric portions made by punch sets 28, 30, 32 and 34. Knockouts having different combinations of portions from those described or having portions having diameters different from those produced by punch sets 26, 28, 30, 32 and 34 can be made by substituting punch sets of different diameter in the die set or by adding such punch sets in additional die sets. The cutting punches have one or more recesses at their periphery. This produces the anchors that retain the cut portions of the knockout. The widths of these anchors, and thus of the recesses, is selected to that the cut portions can be easily removed by the installer, but otherwise stay in place. In one embodiment, sheet stock of one-sixty thousandths of an inch had anchors of the same width.

The die sets can include several different types of punch sets. For example, punch sets 52 and 54 produce small diameter, e.g., mounting, holes. Punch set 56 produces a rectangular opening. Punch sets 58, 60 and 62 are cluster dies for producing knockouts having two concentric portions. Although multiple knockouts are preferably made as described above, cluster dies might still be utilized for simple, e.g., two concentric ring, knockouts.

Figure 3:
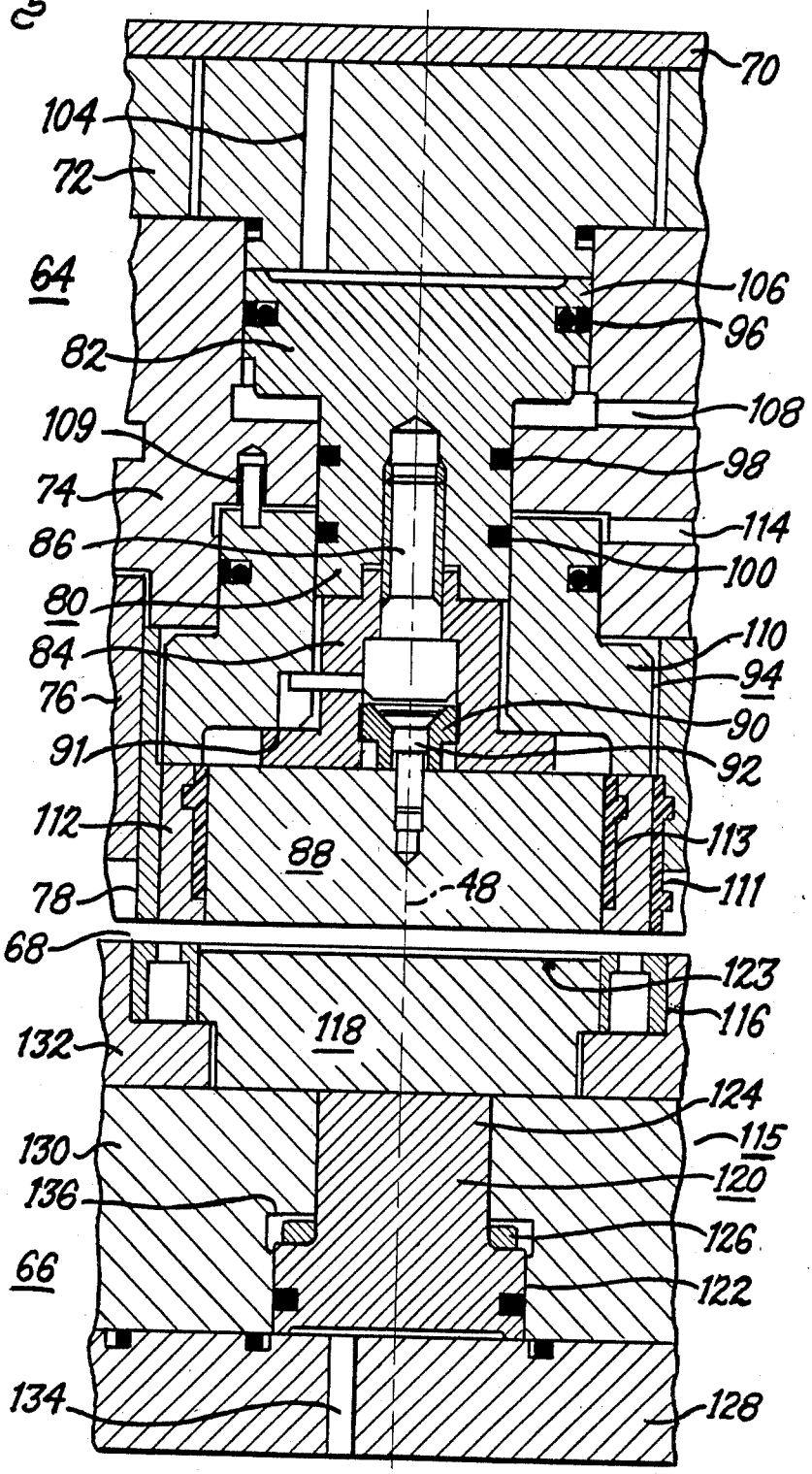
FIG. 3 is a vertical cross section of a punch set adapted for downward movement of the cutting punch.
Figure 4:
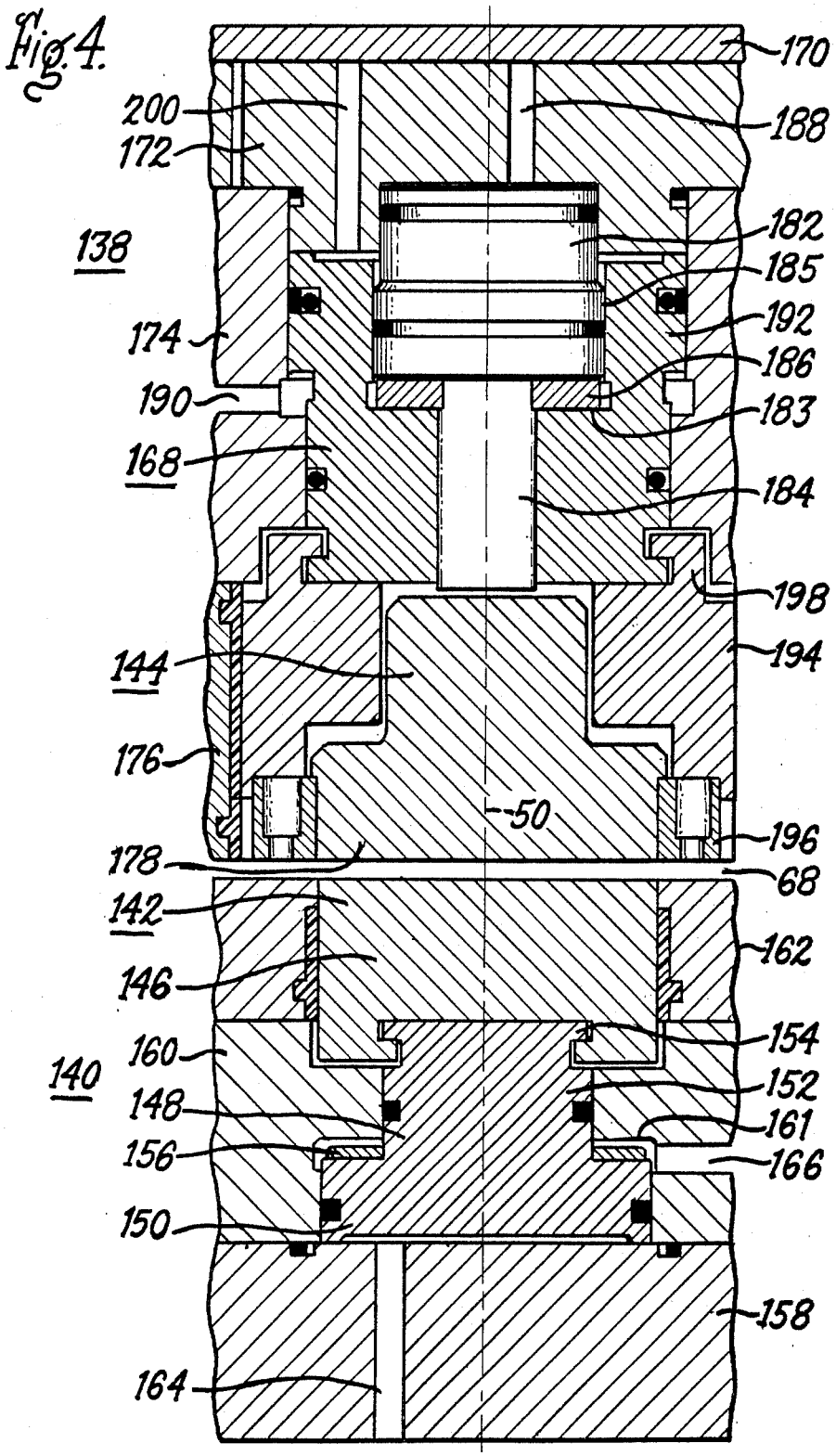
FIG. 4 is a vertical cross section of a punch set adapted for upward movement of the cutting punch.

The punch sets 26–34 described above are of two types, as identified in Table I: those having a downward moving cutting punch (26, 30, 34) and those having an upward moving punch (28, 32). FIG. 3 illustrates a punch set of the downward type and FIG. 4 illustrates a punch set of the upward type in vertical section. (The cutting punch diameters of punch sets 26–34 differ from one another. The cutting punch diameters of FIGS. 3 and 4 are not scaled to any specific punch set.) Although illustrated separately, both punch sets are in the same die set and should be viewed as being arranged side by side and as having some common die members as subsequently explained.

Attention is now directed to FIG. 3 which illustrates the upper die assembly 64 and the lower die assembly 66 of a downward punch set, e.g., 26. These assemblies are positioned in upper and lower magazines of the hydraulic machine, respectively, so as to provide a horizontally extending gap 68 between the die assemblies. During operation, the planar sheet stock is horizontally inserted into the gap. Thus, the gap height corresponds to the thickness of the stock plus some additional space to provide for some vertical deformation of the sheet stock and for sufficient clearance to permit the stock to be moved and positioned. The stock is horizontally positioned so that the center of the knockout to be formed in the sheet stock is coaxially aligned with the longitudinal center axis of the punch set incorporated in assemblies 64 and 66, e.g., center axis 48 of punch set 26. The sheet stock is preferably positioned by gripper plates that engage the side edges of the stock. The above referenced Salvagnini hydraulic machine positions the stock automatically with a digital control system. The control system stores data representative of the x-y coordinate position of the center of the knockout relative to the outer dimensions of the sheet stock. It also stores data representative of the center axis of the die set and of the x-y coordinate offsets of the respective center axes of the punch sets that are utilized to make the knockout. The control system thus commands movement of the grippers to co-align the knockout center with the longitudinal center axis of the punch set.

The upper die set assembly 64 comprises a cutting punch assembly 80 and a surrounding stripper assembly 94. These movable assemblies are contained in stationary components comprising: top cover, i.e., distribution plate 70; cylinder head 72; cylinder plates 74; and punch plates 76 and 78.

The cutting punch assembly 80 comprises cutting punch 88, insert 90, displacement plunger 84 and piston 82. These components are secured to one another as follows. Insert 90 is captured within plunger 84. Bolt 92 secures cutting punch 88 to insert 90, and bolt 86 secures plunger 84 to piston 82. The cutting punch assembly 80 is adapted for vertical downward motion and subsequent retraction with respect to the stationary components. For this purpose, gaskets, such as 96, 98 and 100 and bushing 113, are secured between components of the punch assembly and its surrounding components. Punch assembly 80 is moved by a pressurized hydraulic system comprising oil port 104 which extends to the top of head 106 of the piston, and oil port 108 which extends to the underside of the piston head 106. If fluid pressure in port 104 exceeds that of port 108, the cutting punch assembly moves down. If pressure in port 108 exceeds that of port 104, the cutting punch assembly retracts.

Stripper assembly 94 comprises sleeve 110 and blankholder 112. If fluid pressure is introduced at the top of sleeve 110 via oil port 114, the sleeve is moved down causing downward ejection of the blankholder. The blankholders remain ejected and hold the sheet stock when cut portions are restored. The blankholders are retracted upon retraction of the cutting punch. At such time fluid pressure is relieved via hydraulic cylinder 109. Molded bushings 111 and 113 extend on the outer-walls of the blankholders to assure accurate motion of the stripper assembly and to avoid its rotation.

The lower die assembly comprises an integral embedding punch assembly 115 and a stripper assembly 116 mounted in stationary components. The stripper assembly contains spring ball lifters used for stripping sheet stock off the lower die assembly after a portion of sheet stock is cut and restored. The stationary components include bottom cover 128, cylinder plate 130 and die plate 132. The embedding punch assembly 115 can move upward to at least partially reinsert the portion that was previously cut by the cutting punch into the surrounding sheet stock. Assembly 115 comprises embedding punch 118 and piston 120. Piston 120 has a piston head 122 and an upward extending plunger portion 124. The upper end of the plunger is secured to the underside of the embedding punch. As shown in FIG. 3, when the embedding punch is retracted, the top surface 123 of the piston head is below the top surface of die plate 132. This is required to permit downward displacement of the portion of sheet stock that is cut by the cutting punch. A collar 126 extends about plunger 124 and is secured to an upper surface of the piston head 122 that extends radially outward from the plunger. The embedding punch can be raised with its top surface 123 approaching the horizontal plane of the top surface of die plate 132. The embedding punch assembly is raised and retracted by a hydraulic circuit. Thus, pressurized fluid introduced into port 134 exerts pressure against the lower surface of piston head 122 to extend the retracted embedding punch upward. Upward movement of the embedding punch is limited to a predetermined height by the vertical clearance between the upper surface of collar 126 and the lower flange surface 136 of cylinder plate 130. The stripper assembly 116 comprises spring ball lifters that lift off the sheet stock from the lower die assembly upon completion of the punch and set back operation.

FIG. 4 illustrates the upper and lower die sets 138 and 140, respectively, that incorporate an upward cutting punch set, such as punch set 28. The upward cutting punch set is similar in operation to the downward cutting punch set. However, the position of the cutting and embedding punches are reversed, with the cutting punch assembly 142 installed in the lower die set and the embedding punch assembly 144 installed in the upper die set.

The lower die set 140 comprises the cutting punch assembly 142 including cutting punch 146 and piston head assembly 148. Assembly 148 has a piston head 150 and upwardly extending plunger 152 whose flanged upper portion 154 is captured in a recess formed in the lower portion of the cutting punch. Collar 156 concentrically extends about the plunger and is secured to the upper surface of the piston head. The cutting punch assembly is retained in the following stationary components: bottom plate 158, cylinder plate 160, and die plate 162. The punch sets illustrated in FIGS. 3 and 4 may be installed adjacent to one another in a common die set. In such case, stationary components 158, 160 and 162 are common with or are extensions of stationary components 128, 130 and 132, respectively, of the lower die set of FIG. 3. The cutting punch assembly 142 is moved upward by a pressurized hydraulic system comprising oil port 164 which extends to the bottom of piston head 150 and oil port 166 which extends to the top of collar 156. If fluid pressure in port 164 exceeds that of port 166, the cutting punch assembly moves upward. If pressure in port 166 exceeds that of port 164, the cutting punch assembly retracts.

The upper die set assembly 138 comprises an embedding punch assembly 144, a stripper assembly 168 and the following stationary components: upper cover, i.e., distribution, plate 170; cylinder head 172; cylinder plate 174; and punch plate 176. If the punch sets of FIGS. 3 and 4 are installed adjacent to one another in the same die sets, stationary components 170, 172, 174 and 176 are common with or are extensions of the corresponding stationary components of the upper die set of FIG. 3. The embedding punch assembly 144 comprises embedding punch 178 and a piston assembly of piston head 182, downward extending plunger 184 and collar 186. The collar abuts the underside 183 of the piston head and concentrically surrounds the plunger. The embedding punch 178 strokes downward and is retracted by a pressurized hydraulic system comprising oil port 188, which extends to the top of the piston head 182, and oil port 190, which extends to the bottom of the piston head. The stripper assembly 168 comprises cylinders 192, 194 and hydraulic ball lifters 196. Upper cylinder 192 extends contiguously about piston head 182, collar 186 and plunger 184. The lower cylinder 194 has at its top an upward and inwardly extending flange portion 198 that engages a mating recess in the lower portion of the upper cylinder 192. The hydraulic ball lifters 196 are in turn secured to the lower portion of cylinder 194 such that the entire stripper assembly 168 can be extended downward and retracted by a hydraulic circuit. The latter comprises oil port 200 which extends to the top surface 202 of the upper cylinder.

Figure 5:
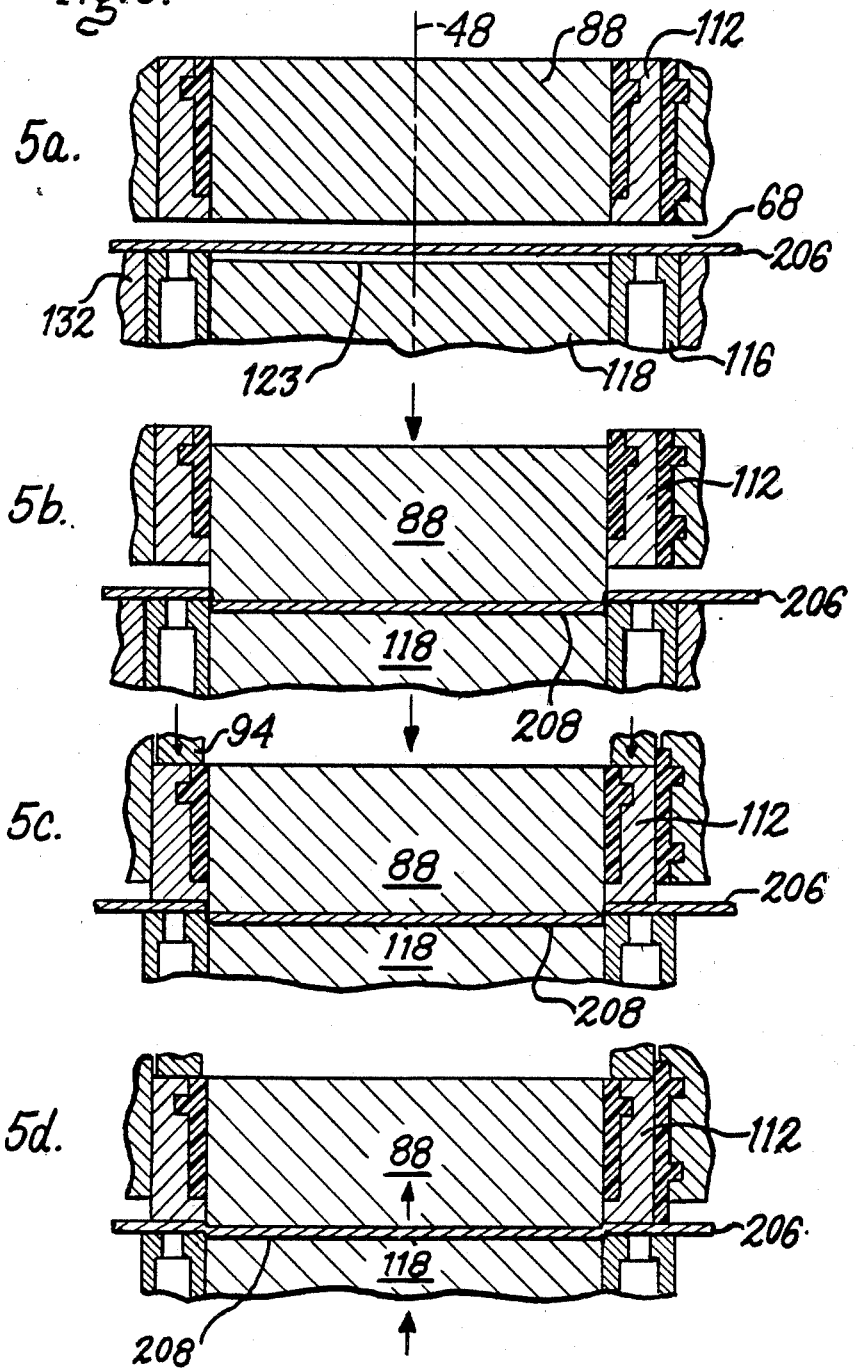
FIGS. 5*a*, 5*b*, 5*c* and 5*d* are simplified vertical cross sectional views of the operation of a punch set with a downward moving cutting punch.

The following describes manufacture of a multiple knockout with concentric portions produced by punch sets 26–34. Operation is described with respect to FIGS. 3, 4, 5 and 6. As previously indicated, the illustrated punch sets are not dimensioned with respect to the diameter of a specific punch set. FIGS. 3–6 are intended to convey the operation of the upward and downward punch sets with respect to punchings of differing diameter. The initial punching of smallest diameter, such as punch set 26, may be produced by a downward punch set, such as 26 of FIG. 3, in a sequence illustrated in FIG. 5. As shown in FIG. 5*a*. sheet stock 206 is inserted in gap 68 so that the center of the eventual knockout is coaxial with center axis 48 of the punch set. Cutting punch 88 and blank holders 112 are in their retracted position and the top surface 123 of embedding punch 118 is approximately flush with the top surfaces of die plate 132 and of stripper 116.

A hydraulic valve is actuated to introduce, via port 104, hydraulic pressure to the top of piston head 106. It should be noted that the strokes of the various cutting and embedding punches are produced by applying high hydraulic pressure such as, for example, 360 atmospheres. As shown in FIG. 5*b*, the cutting punch 88 thus descends to cut a circular portion 208 of the work piece, except for one or more anchors. Portion 208 is ejected below the plane of the sheet stock with resulting descent of the embedding punch. The hydraulic force on the cutting punch is then removed.

Next, hydraulic pressure via port 114 depresses stripper assembly 94 so that blank holders 112 descend to abut against sheet stock 206, as shown in FIG. 5*c*. Hydraulic pressure, via port 134, then forces embedding punch 118 up against portion 208 as shown in FIG. 5*d*. Cut portion 208 is thus at least partially, e.g., two-thirds, restored into the plane of sheet stock 206 and cutting punch 88 is partially retracted.

Hydraulic pressure, via port 108, fully retracts cutting punch assembly 80. As evident from FIG. 3, upon such retraction, the lower shoulder 91 of displacement plunger 84 abuts against a lower wall portion of stripper sleeve 110. This results in the simultaneous retraction of the stripper assembly 94, including blank holders 112, from the sheet stock. Cutting punch 88 and blank holders 112 thus are again retracted to the positions illustrated in FIG. 5*a*. At such time, the spring ball lifters of stripper assembly 116 lift the sheet stock of the lower die assembly and the operation of punch set 26 is completed.

Figure 6:
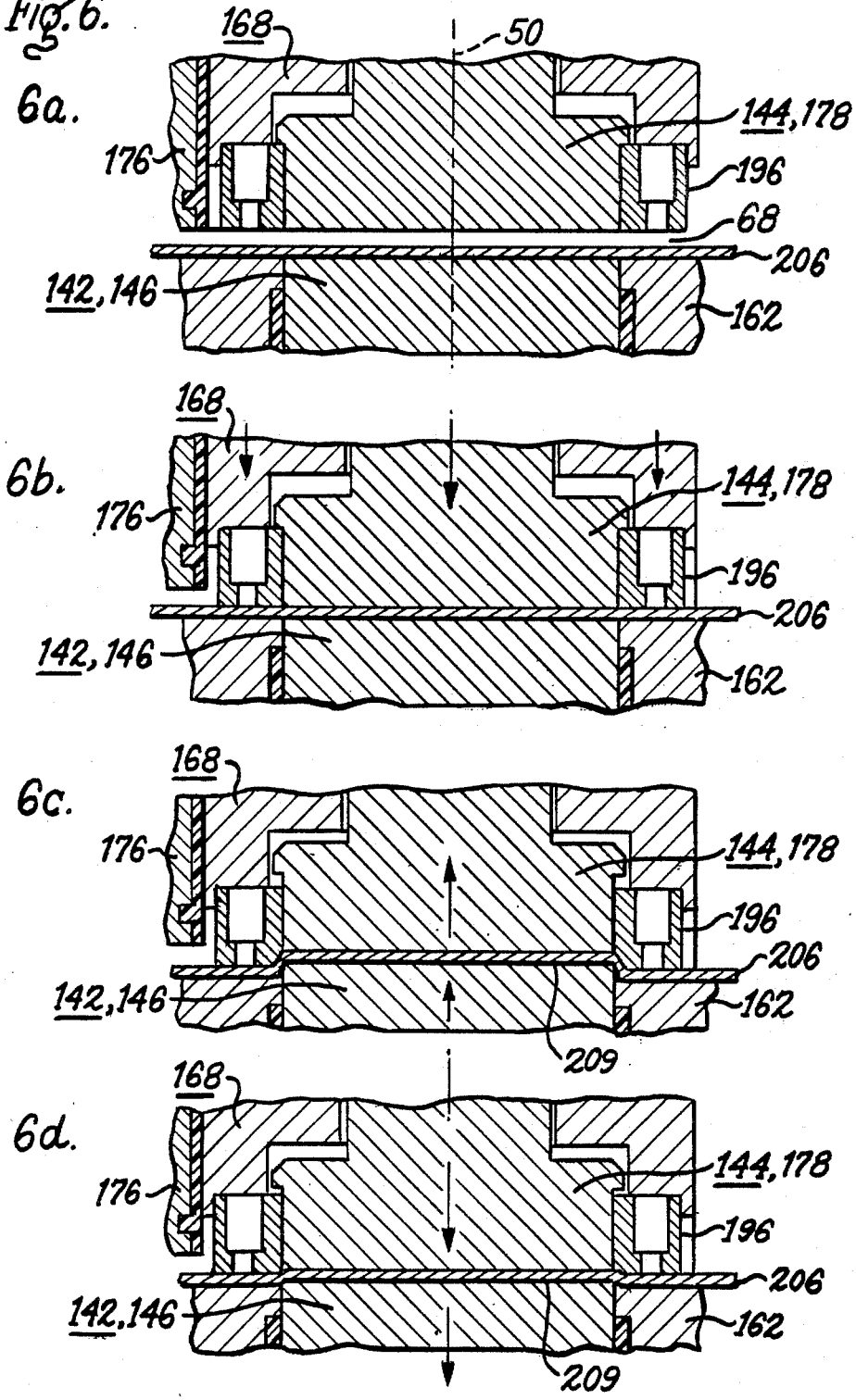
FIGS. 6*a*, 6*b*, 6*c* and 6*d* are simplified vertical cross sectional views of the operation of a punch set with an upward moving cutting punch.

Operation continues with respect to the punch set of next larger diameter, such as, for example, punch set 28. If the previously punched knockout was produced by a downward cutting punch set, operation continues with an upward cutting punch set of the type illustrated in FIG. 4. This operation is illustrated by FIG. 6. Per FIG. 6*a*, sheet stock 206 is repositioned in gap 68 until the center of the knockout is coaxial with center line 50 of punch set 28. For simplicity, FIG. 6*a* illustrates the sheet stock as being flat and without having any prior knockout punching. Hydraulic pressure, via port 200, forces stripper assembly 168 of the upper die set down against the sheet stock. This hydraulic pressure also acts against the lower portion 185 of piston head 182 resulting in descent of embedding punch assembly 144. As shown in FIG. 5*b*, the spring ball lifters 196 of the stripper assembly and embedding punch 178 abut sheet stock 206.

Hydraulic pressure, via port 164, raises the cutting punch assembly 142. As shown in FIG. 6*c*, cutting punch 146 ascends by approximately the thickness of sheet stock to cut a second circular portion 209 of stock, except for one or more anchors. As evident from FIG. 4, the upward stroke of the cutting punch is terminated upon engagement of the top of collar 156 of the cutting punch assembly with a lower wall surface 161 of cylinder plate 160. The second circular portion of the stock, concentrically surrounding the first circular portion, is thus cut and raised above the plane of the sheet stock. This causes embedding punch 178 to partially retract as shown in FIG. 6*c*.

Stripper assembly 168 is still in its downward ejected position, i.e., below that shown in FIG. 4. Thus, wall surface 183 of its upper cylinder 192 is displaced below the lower surface of collar 186 of the embedding punch assembly 144. Hydraulic pressure, via port 188, produces a downward stroke of the embedding punch assembly 144. Assembly 144, including embedding punch 178, descends for a limited distance until collar 186 impinges on wall surface 183 of the upper cylinder. This at least partially restores the cut portion 209 into the plane of the sheet stock as shown in FIG. 6*d*. In one embodiment, displacement was limited to leave about one-third of the cut out portion above the surface of the sheet stock.

Finally, stripper assembly 168 and embedding punch assembly 144 are simultaneously retracted by hydraulic pressure introduced via port 190 to a position similar to that shown in FIG. 6*a*. Spring ball lifters 196 of the stripper assembly concurrently strip the sheet stock off the die set.

Figure 7:
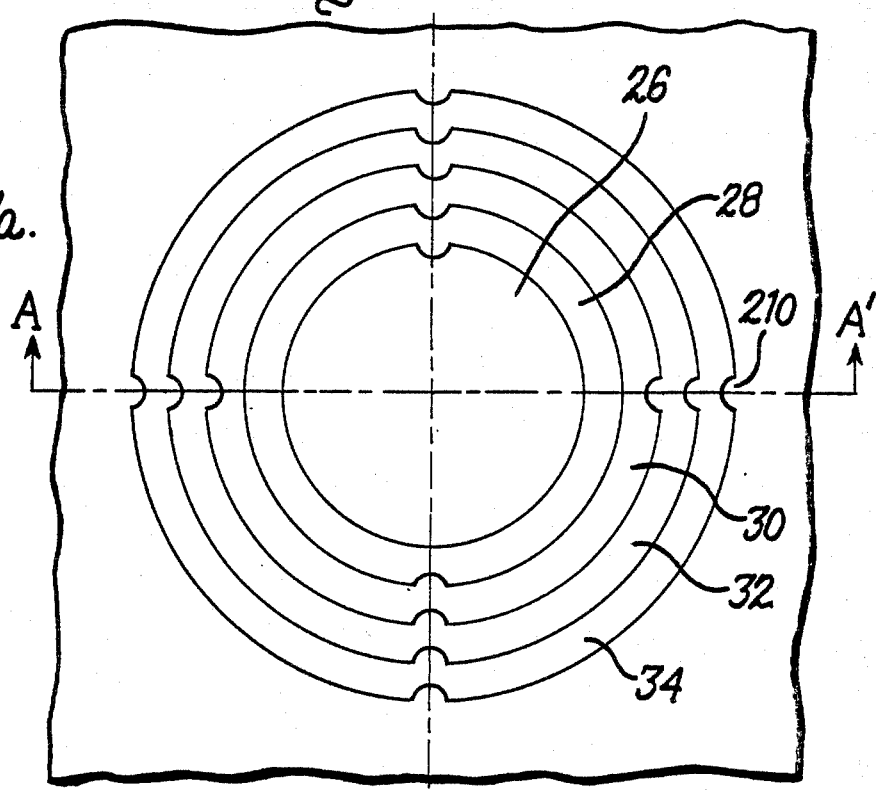
FIG. 7*a* is a plan view of a multiple knockout produced in accordance to the invention.
FIG. 7*b* is a cross sectional view of the knockout taken on line A—A′ of FIG. 7*a*.
Figure 7:
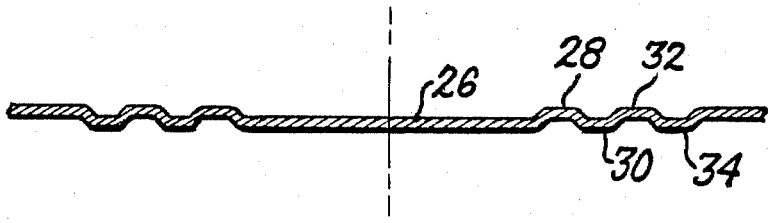

Having explained the operation of a downward punch set and of an upward punch set, it can be readily understood how the sheet stock is successively positioned with respect to additional punch sets and how these punch sets cut successive concentric portions of the multiple knockouts. In case of a five piece concentric knockout, produced by punch sets 26, 28, 30, 32 and 34, the sheet stock would next be positioned and cut, successively by punch sets 30, 32 and 34. This would produce a five piece knockout having the general configuration of FIG. 7. In the plan view of FIG. 7*a*, each of the five concentric punchings is identified by the number of the punch set that produced it. Anchors are generally identified as 210. In this embodiment, the inner punching (26) is retained by one anchor, punching (28) by two anchors, and the remaining punchings by four anchors. The cross sectional view of FIG. 7*b* illustrates the partial set back of the punched portions.

It should be apparent to those skilled in the art that while the preferred embodiment has been described in accordance with the Patent Statutes, changes may be made in the disclosed embodiment without actually departing from the true spirit and scope of the invention.

What we claim as new and desire to secure by Letters Patent of the United States is:

1. The method of forming a knockout of multiple cut portions in a planar portion of sheet metal to be formed into wall members of equipment cabinets such that the multiple portions of the knockout surround one another and are cut about their periphery except for one or more retaining anchors, comprising the steps of:

(a) providing a hydraulic press having a plurality of punch sets of differing cutting perimeters, each having a cutting punch and an embedding punch displaced on opposing sides of the planar portion of sheet metal;

(b) sequentially positioning the planar portion of sheet metal with respect to different punch sets of successively increasing cutting perimeter for sequentially cutting portions that surround previously cut portions of the sheet metal; and (c) at each of the sequential positions of the sheet metal displacing the cutting punch in a direction orthogonal with respect to the plane of the planar portion of sheet metal to cut a portion of sheet metal about its periphery except for one or more retaining anchors and subsequently displacing the embedding punch in a direction opposite to the displacement of the cutting punch to restore the cut portion into the plane of the sheet metal sufficiently to preclude occlusions between the cut portion and the remaining portions of the sheet metal.

2. The method of forming the knockout of claim 1 comprising the further steps of:

(a) positioning the embedding punch to substantially abut the sheet metal prior to displacing the cutting punch to cut a portion of sheet metal; and (b) retracting the embedding punch upon displacement of the cutting punch to permit the cut portion to extend beyond the plane of the sheet metal.

3. The method of forming the knockout of claim 1 wherein the plurality of punch sets have a cutting punch of circular cutting periphery and wherein the planar portion of sheet metal is sequentially positioned so that the center of the knockout is coaxial with the center axes of the punch sets to sequentially cut portions of circular circumference that are concentric to one another.

4. The method of forming the knockout of claim 3 comprising the further steps of:

(a) positioning the embedding punch to substantially abut the sheet metal prior to displacing the cutting punch to cut a portion of sheet metal; and (b) retracting the embedding punch upon displacement of the cutting punch to permit the cut portion to extend beyond the plane of the sheet metal.

5. The method of forming a knockout according to claims 1, 2, 3 or 4 further comprising the steps of:

(a) mounting the punch sets in the press such that successively used punch sets of increasing cutting perimeter have their cutting punches arranged on alternate sides of the planar portion of the sheet metal; and (b) sequentially displacing the cutting punches of successive sets of punch sets of increasing cutting perimeters in alternate directions such that successively cut portions of the knockout are cut in opposing directions.

6. The method of forming a plurality of concentric knockouts into sheet metal to be formed into wall members of electrical equipment cabinets, comprising the steps of:

(a) providing a hydraulic press having a plurality of punch sets of differing cutting diameter, each of the punch sets having a cutting punch and an embedding punch;

(b) positioning a sheet metal member between the cutting punch and the embedding punch of a first punch set;

(c) displacing the cutting punch of a first punch set in a first direction orthogonal to the sheet metal to cut a first circular portion of the sheet metal, except for one or more retaining anchors, and to displace it in said first direction;

(d) displacing the embedding punch of the first punch set in a second direction opposite to the first direction to restore the first circular portion into the plane of the sheet metal to preclude occlusions between the first circular portion and the remaining portions of the sheet metal;

(e) positioning the sheet metal member intermediate the cutting punch and embedding punch of a second punch set having a cutting diameter greater than that of the first punch set;

(f) displacing the cutting punch of the second set in the second direction to cut a second circular portion of the sheet metal so that said second circular portion substantially surrounds said first circular portion, except for one or more retaining anchors, and to displace it in the second direction; and (g) displacing the embedding punch of the second set in the first direction to restore the second circular portion into the plane of the sheet metal to preclude occlusions between the second circular portion and the remaining portions of the sheet metal.

7. The method of forming concentric knockouts of claim 6 further comprising the steps of:

(a) positioning the sheet metal member intermediate the cutting punch and embedding punch of at least one additional punch set of greater diameter than said first and second punch set;

(b) displacing the cutting punch in the first direction to cut a third circular portion; and (c) displacing the embedding punch in the second direction to restore the third circular portion into the plane of the sheet metal to preclude air gaps between the second circular portion and the remaining portions of the sheet metal.

8. The method of forming a knockout of multiple cut portions in a planar portion of sheet metal to be formed into wall members of equipment cabinets such that the multiple portions of the knockout surround one another and are cut about their periphery except for one or more retaining anchors, comprising the steps of:

(a) providing a hydraulic press having a plurality of punch sets of differing cutting perimeters, each having a cutting punch and an embedding punch displaced on opposing sides of the planar portion of sheet metal such that successively used punch sets of increasing cutting perimeter have their cutting punches arranged on alternate sides of the sheet metal;

(b) sequentially positioning the planar portion of sheet metal with respect to different punch sets of successively increasing cutting perimeter for sequentially cutting portions that surround previously cut portions of the sheet metal; and (c) sequentially displacing the cutting punches of successively utilized sets of punch sets of increasing cutting perimeters in alternate directions such that successively cut portions of the knockout are cut in opposing directions.

9. The method of forming the knockout of claim 8 comprising the further steps of:

(a) positioning the embedding punch to substantially abut the sheet metal prior to displacing the cutting punch to cut a portion of sheet metal; and retracting the embedding punch upon displacement of the cutting punch to permit the cut portion to extend beyond the plane of the sheet metal.

10. The method of forming the knockout of claim 8 or 9 wherein the plurality of punch sets have a cutting punch of circular cutting periphery and wherein the planar portion of sheet metal is sequentially positioned so that the center of the knockout is coaxial with the center axes of the punch sets to sequentially cut portions of circular circumference that are concentric to one another.

* * * * *